US007377062B2

(12) United States Patent
Ellerton

(10) Patent No.: US 7,377,062 B2
(45) Date of Patent: May 27, 2008

(54) CURVED FACE AIRPORT GUIDANCE SIGN

(76) Inventor: Andrew B. Ellerton, 256 Lafayette Rd., Syracuse, NY (US) 13205

( * ) Notice: Subject to any disclaimer, the term of this patent is extended or adjusted under 35 U.S.C. 154(b) by 315 days.

(21) Appl. No.: 11/365,404

(22) Filed: Mar. 1, 2006

(65) Prior Publication Data

US 2007/0204496 A1 Sep. 6, 2007

(51) Int. Cl.
*G09F 13/04* (2006.01)

(52) U.S. Cl. ..... 40/564; 40/700

(58) Field of Classification Search ..... 40/564, 40/700, 575, 576

See application file for complete search history.

(56) References Cited

U.S. PATENT DOCUMENTS 1,479,485 A * 1/1924 Van Bloem ..... 40/563
3,090,033 A * 5/1963 Cleary et al. ..... 362/351
3,593,447 A * 7/1971 Winegarten ..... 40/564
4,424,449 A * 1/1984 O'Brill ..... 250/461.1
5,582,477 A * 12/1996 Reinert, Sr. ..... 362/153.1
5,678,336 A * 10/1997 Jue et al. ..... 40/570
6,946,975 B2 * 9/2005 Hansler et al. ..... 340/947
7,134,764 B1 * 11/2006 Bieberdorf ..... 362/183

OTHER PUBLICATIONS

"Lumacurve Taxiway and Runway Signs," Flight Light, Inc., Data Sheet L-858, Oct. 1, 2003.*
"Evaluation of Wind-Loading on Airport Signs," Keith Bagot, Federal Aviation Administration, Jun. 2000.*

* cited by examiner

*Primary Examiner*—Gary C Hoge
(74) *Attorney, Agent, or Firm*—Bernhard P. Molldrem, Jr.

(57) ABSTRACT

An improved illuminated airfield guidance sign of the type used for marking ground traffic routes on runways and taxiways has a curved face. The sign is capable of withstanding the prescribed wind load tests and at the same time has even illumination across each of its legend panels. The curved legend panels are preferably formed of sheets of acrylic or equivalent substrate with a thickness of about 0.354 inches except at the edges where the edge portion is about 0.220 inches. The edge portion i.e. peripheral flange fits into the grooves or channels along the base and end panels of the frame.

6 Claims, 3 Drawing Sheets

CURVED FACE AIRPORT GUIDANCE SIGN

BACKGROUND OF THE INVENTION

The present invention relates to a illuminated airfield signs of the type used for marking ground traffic routes on runways and taxiways. The invention is more particularly concerned with an improved airport guidance sign having a curved face, and which is capable of with-standing the prescribed wind load tests and at the same time has even illumination across its legend panel(s).

Illuminated guidance signs are commonly used at airports to identify runways and taxiways and provide ground route marking information for air crews. These guidance signs have transparent or translucent legend panels supported in a frame or case, with the case being supported on legs that provide a minimum ground clearance.

Guidance signs with curved or bowed faces have become a preferred design at many airports, because the design of the curved face inherently sheds jet blast better than a standard flat face, and because the design provides balanced lighting and even illumination without complex internal mechanism.

The standards for airport guidance signs in the United States are established by the Federal Aviation Administration, and in particular the Specification for Runway and Taxiway Signs, as specified in Advisory Circular 150/5345-44G, which was issued Jul. 8, 2004. This specification requires a wind load and frangibility test (paragraph 4.1.1.2), in which a simulated wind load, i.e., a static load of 0.9 psi is uniformly applied to the entire face of the legend panel for ten minutes, and after which both the legend panels and the support legs are inspected for damage. For the sign to pass this test, there can be no evidence of breakage or distortion. Then the static load applied to the sign legend panel is increased until the frangible connector of the support leg gives way, and this frangible point failure must occur before the legend panel loading reaches a static pressure load of 1.3 psi for classification as a Mode 2 sign or 2.0 psi for classification as a Mode 3 sign. Again the sign is inspected for damage and there can be no distortion of breakage of the legend panel.

The frangible connector is intended to provide a safe failure mode for the signs so that the danger is minimized, for example, if an aircraft rolls into or over a guidance sign.

It has recently been discovered that the guidance signs with curved legend panels do not always withstand the static loads as prescribed in this test, and may fail due to flexure and distortion of the curved legend panels under the simulated wind load. Accordingly, it has become necessary to find ways to avoid buckling or distortion that arises under the pressures of the above test specification. This includes adding material to the case or frame to combat buckling, or adding internal ties and supports. However, these approaches can create undesirable shadows and bright spots in the legend panels, and can affect their readability adversely.

OBJECTS AND SUMMARY OF THE INVENTION

Accordingly, it is an object of this invention to provide an illuminated guidance sign with curved faces that avoids the drawback of the prior art.

Another object is to provide a guidance sign which has evenly illuminated legend panels, and which can withstand the prescribed wind and pressure loads without breakage or distortion.

It is yet another object to provide for increasing strength of existing curved face guidance signs simply by replacing the curved legend panels.

In accordance with an aspect of the present invention, an illuminated airport guidance sign has a pair of curved translucent or transparent legend panels that are made of sheets of a sturdy plastic material. The legend panels are bowed out in respect to a generally horizontal axis. A sign frame supports the legend panels in a symmetric, oppositely facing orientation. The frame has grooves or channels along its edges, with straight groove portions along the base portion of the frame to support a lower edge of an associated legend panel, and curved grooves or channels along sides of its end panels. These grooves or channels extend along a curve to support curved side edges of the associated legend panel. The base closes off the bottom of the sign and a top cover closes off the top of the sign. One (or more) lamps are supported within the sign or sign module between the legend panels, and these have supporting electrical power circuitry for providing current to the lamps so as to produce even illumination to the legend panels. Under the base, support legs hold the sign in place with clearance above the ground on a support surface alongside a runway or taxiway. In these guidance signs, each of the support legs has a frangible coupling designed to break at a predetermined stress, as discussed earlier.

The guidance signs of this invention include the improvement in which each of the curved translucent legend panels is formed with the sheet of translucent plastic material being of an increased thickness, except at the edges. That is, the legend panel has a thickness on the order of about ⅜ inches between its edges, this thickness being sufficient to resist deflection of the legend panel under forces equal to or less than the predetermined design failure stress for the frangible couplings. Edge portions along each edge are a lesser thickness (i.e., the same as the standard panel thickness in the prior design) to fit into the frame grooves or channels. In a preferred mode, the legend panels each are formed of an acrylic sheet of about 0.354 inches thickness with edge portions about 0.220 inches in thickness. Favorably, the edges are formed by creating edge recesses, wherein the edge recesses are disposed at an outwardly disposed face of the panel. This creates a peripheral edge flange disposed at the inward face of the curved panel.

The guidance signs of this construction meet the wind loading test requirements of Advisory Circular 150/5345-44G, without distortion or fracturing of the frame or panels. Moreover, by replacing the legend panels of existing curved guidance signs with replacement legend panels of this construction, those guidance signs also pass this wind loading test.

The above and many other objects, features, and advantages of this invention will become apparent to persons skilled in the art from the ensuing description of a preferred embodiment, which is to be read in conjunction with the accompanying Drawing.

DETAILED DESCRIPTION OF THE PREFERRED EMBODIMENTS

Figure 1:
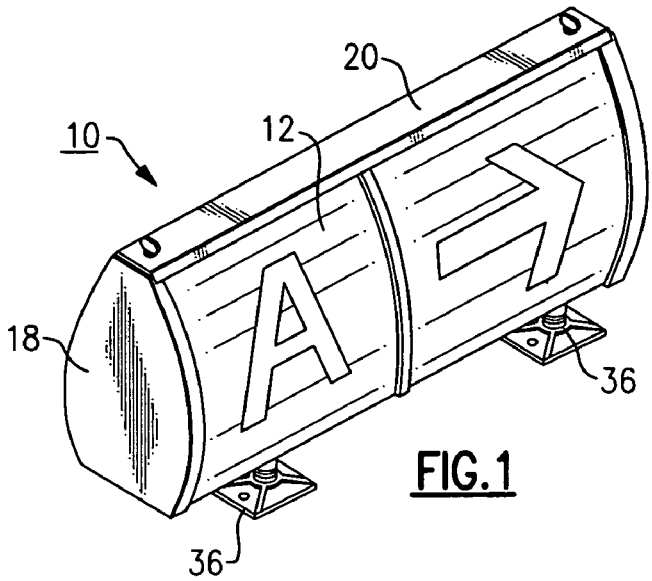
FIG. 1 is a perspective view of a guidance sign of an embodiment of this invention.
Figure 2:
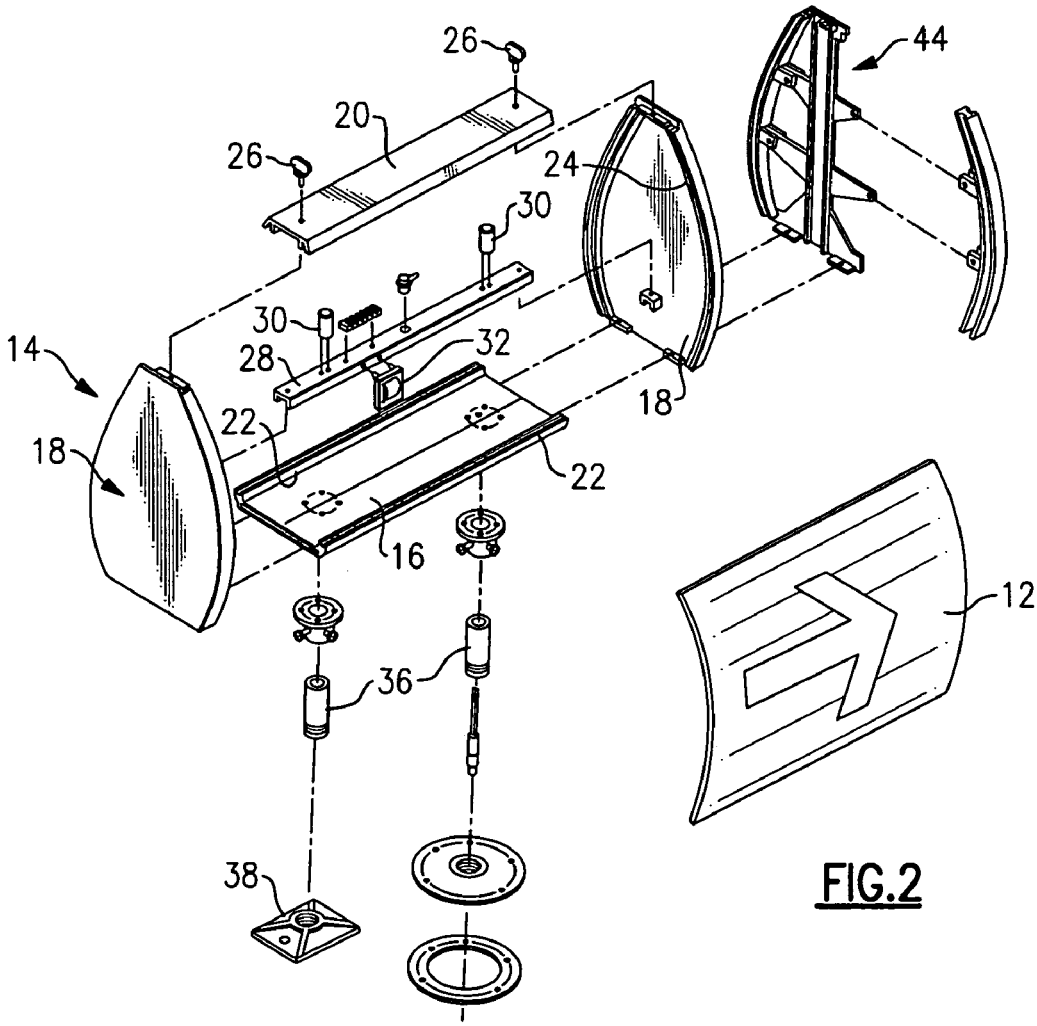
FIG. 2 is an exploded assembly view of this embodiment of this invention.

With reference to the Drawing, and initially to FIGS. 1 and 2, a curved-face airport guidance sign 10 of this invention is of the illuminated type, which has curved transparent or translucent legend panels 12 supported in a metal case or frame 14. The panels 12 are formed from sheets or panels of a sturdy plastic material, i.e., a substrate such as acrylic, with a letter, number or symbol appearing on the outer surface. Other substrates, e.g., polycarbonate or a hybrid, could be used. These legend panels are used to identify a runway or taxiway, and/or to give directional information to assist the air crew in ground navigation. The size and visibility of the legends is governed by FAA Advisory Circular 150/5345-44G.

As shown in FIG. 2, the frame or case 14 has a flat floor or base member 16, side members or end panels 18, and a top cover 20, which fit together and retain the pair of legend panels 12. In this case there are horizontal slots or recesses 22 on front and rear edges of the base member 16 and curved slots or recesses 24 on the rising edges of the end panels 18. There are similar slots or recesses in the top cover 20, but these are not visible in this view. The legend panels 12 are inserted into the frame so that the edges are held snugly in the slots 22 and 24, and then the cover 20 is installed at the top of the frame. Turn fasteners 26 secure the cover 20 to the tops of the end panels 18.

Within the frame 14, there is a lamp socket channel 28 extending laterally, and this channel 28 supports one or more three lamp sockets 30, and a brightness control transformer 32 that supplies current to the sockets. Lamps 34 (shown in FIGS. 3 and 4) of the prescribed type are installed in the sockets 30.

Figure 7:
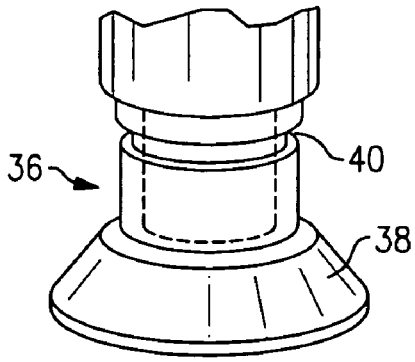
FIG. 7 shows detail of one of the support legs, including the frangible coupling.

The frame 14 is supported above the ground surface, using frangible couplings 36 that are of sufficient length to provide the required ground clearance, e.g., six inches. These support the underside of the frame base member 16, and are fitted into a conventional floor flange 38 that is affixed to the ground surface. In this embodiment, the frangible coupling 36 is a metal tube or nipple and is provided with an annular cutout 40 (See FIG. 7) to weaken the coupling 36 at the position of the cutout so that it will shear at a given stress level, such that it will withstand the required wind load and yet will break off at a higher load, e.g., if run over by an aircraft.

Figure 4:
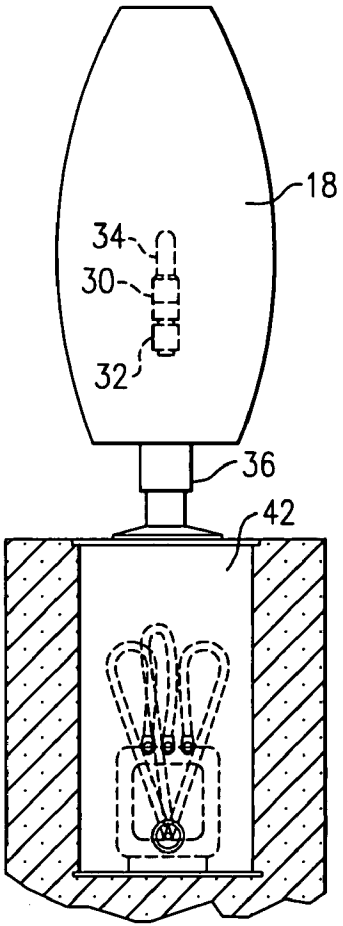
FIGS. 3 and 4 are front and side elevational views of this embodiment.
Figure 3:
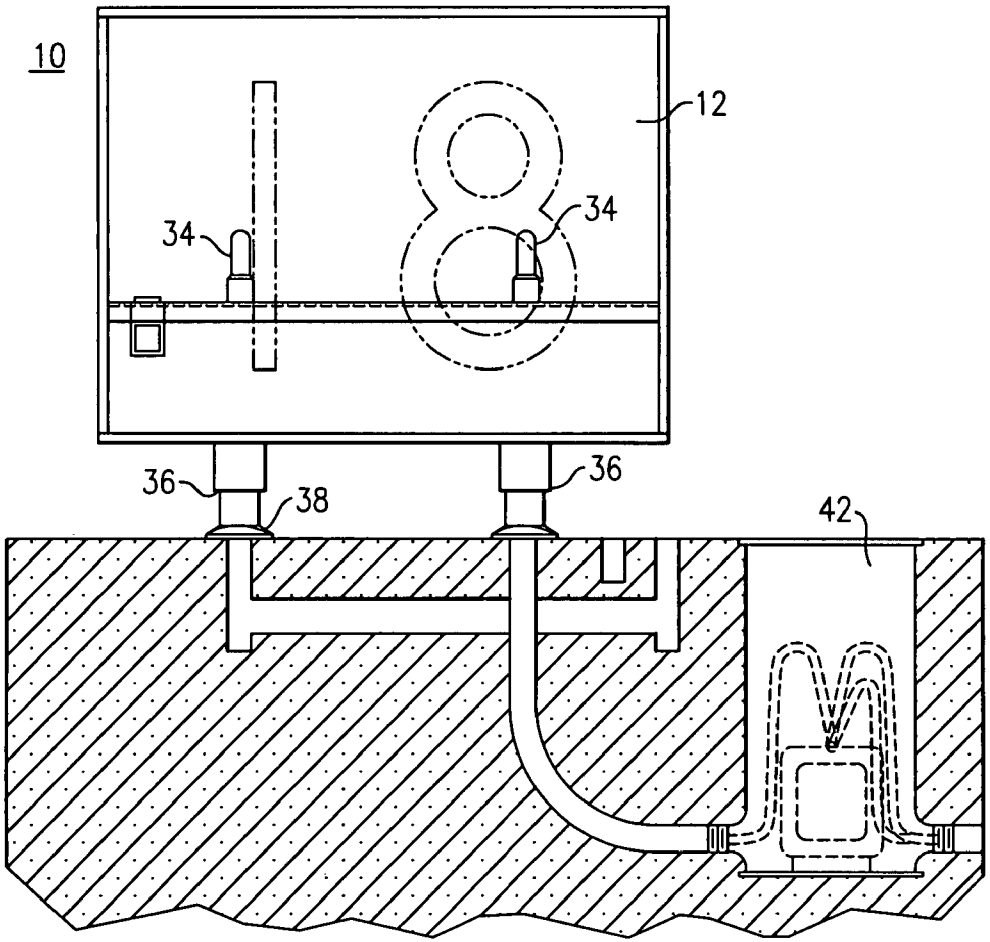

The runway or taxiway sign 10 is shown in front elevation in FIG. 3 and in a side elevation or profile in FIG. 4. These views show a transformer housing 42 disposed in ground adjacent the sign with a transformer for supplying controlled current to the sign. The associated wiring passes through in-ground conduit and upwards through one of the support legs or couplings 36.

Returning briefly to FIG. 2, a multi-module insert 44 can be substituted for one of the end panels 18, and serves as a provision for joining two or more modules to one another, in a known fashion. Here, the insert 44 comprises a pine-tree shaped support member and a pair of curved channel members.

Figure 5:
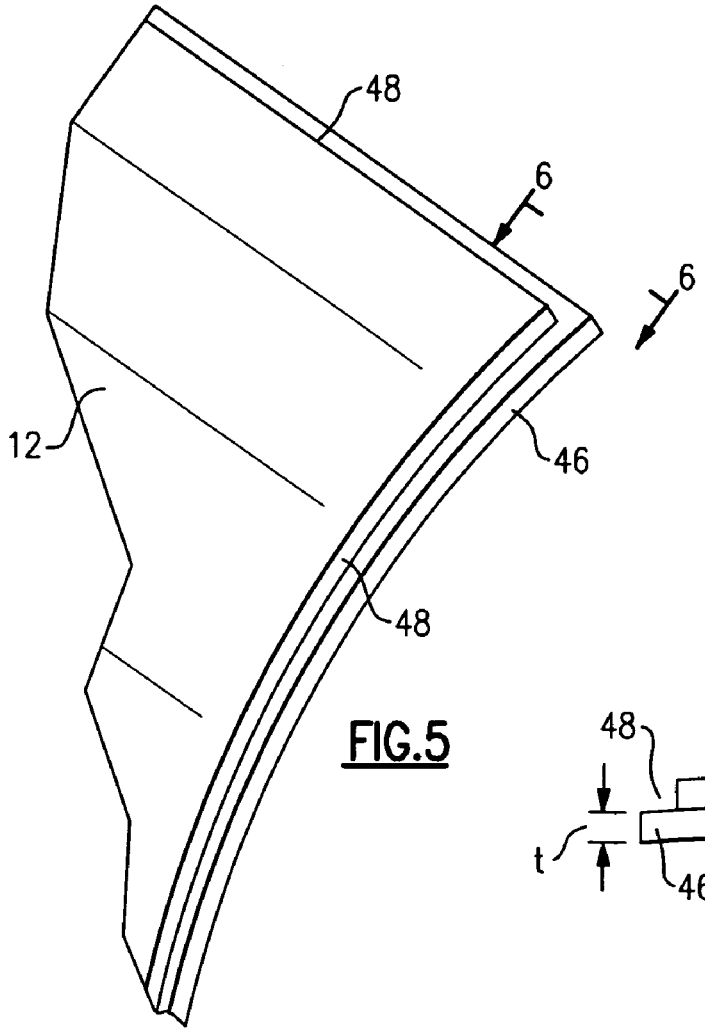
FIGS. 5 and 6 show a portion of the legend panel of this embodiment, with FIG. 6 being taken at 6-6 of FIG. 5.
Figure 6:
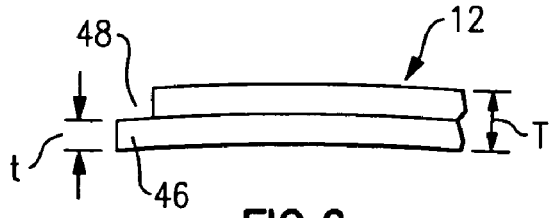

FIGS. 5 and 6 show a portion of the curved legend panel 12 as employed in this embodiment of the invention. The panel 12 is formed of an acrylic sheet of greater thickness than that of a conventional legend panel, except at its edges 46, where an edge recess or cutout 48 forms the edges or peripheral flanges 46 to be of a thickness that matches the dimensions of the slots or recesses 22, 24 in the support frame 14.

In this embodiment the acrylic or equivalent substrate of the legend panel 12 has a thickness T of 0.354 inches in the main portion, but a smaller thickness t of 0.220 inches at the edge portion 46. Preferably, the cutout 48 is formed at the inner side or face of the panel 12, i.e., on the side towards the center of curvature, so that the edge portion 46 is in the same plane as the outer face of the panel 12. This permits the sign to be constructed with the visible face of the legend panel to be uniform all the way into the supporting slots or channels 22, 24.

The airport guidance signs 10 constructed according to the above-described embodiment are able to withstand the required windload forces without deflection or flexing up to the prescribed limits, and do not need internal supports or bracing. Moreover, existing curved panel guidance signs can be converted so as to pass the windload testing by substituting the above-described curved panels 12 for the existing panels of the thinner material.

While the invention has been described in detail with respect to a preferred embodiment, it should be recognized that there are many alternative embodiments that would become apparent to persons of skill in the art. Many modifications and variations are possible which would not depart from the scope and spirit of this invention, as defined in the appended claims.

I claim:

1. In an illuminated airport guidance sign for the type that includes a pair of curved translucent or transparent legend panels formed of a sheet of a sturdy plastic material the legend panels being bowed out in respect to a generally horizontal axis; a sign frame supporting the legend panels in a symmetric oppositely facing orientation, the frame having edge channels that extend straight along a lower portion of the frame to support a lower edge of an associated legend panel, and side channels that extend along a curve to support curved side edges of the associated legend panel; a base closing off the bottom of the sign; a top cover that closes off a top of the sign; one or more lamps supported within the sign between said pair of legend panels; electrical power means for providing current to said lamps so as to produce even illumination from said lamps; support legs supporting the base of said sign upon a support surface alongside a runway or taxiway, each of said support legs including a frangible coupling designed to break at a predetermined stress;

the improvement in which each of said curved legend panels is formed of a sheet of translucent or transparent plastic material that has a thickness on the order of about ⅜ inches between its edges, said thickness being sufficient to resist deflection of said legend panels under forces less than the predetermined design stress of said frangible couplings, and edge portions along each edge of a smaller thickness to fit into said frame edge channels.

2. The illuminated airport guidance sign of claim 1, wherein said legend panels each are formed of an acrylic sheet of about 0.354 inches thickness with edge portions about 0.220 inches in thickness.

3. The illuminated airport guidance sign of claim 1, wherein said legend panels each have an edge recess formed along the margin to define said edge portions thereof.

4. The illuminated airport guidance sign of claim 3, wherein said edge recess is formed at an outwardly disposed face of the legend panel.

5. The illuminated airport guidance sign of claim 3, wherein said edge recess results in a perpheral flange at an inwardly disposed face of the legend panel.

6. The illuminated airport guidance sign of claim 1, wherein said legend panels are supported within said frame only at said edge portions thereof.

* * * * *